US005984157A

United States Patent [19]

Swetish

[11] Patent Number: 5,984,157

[45] **Date of Patent: *Nov. 16, 1999**

[54] SHOULDER SUPPORT STRUCTURE FOR A LOAD CARRYING SYSTEM

[75] Inventor: Thomas R. Swetish, Racine, Wis.

[73] Assignee: Johnson Worldwide Associates, Inc., Sturtevant, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/762,607

[22] Filed: Dec. 9, 1996

[51] Int. Cl.[6] ..... A45F 3/04

[52] U.S. Cl. ..... 224/631; 224/634; 224/638; 224/641

[58] Field of Search ..... 224/628, 631, 224/634, 633, 637–639, 641, 643, 265, 266, 642, 627, 264

[56] References Cited

U.S. PATENT DOCUMENTS

| | | | |
|---|---|---|---|
| 1,879,480 | 8/1932 | Pures . | |
| 2,008,201 | 7/1935 | Chute . | |
| 3,831,827 | 8/1974 | Olson . | |
| 4,015,759 | 4/1977 | Dreissigacker et al. . | |
| 4,049,164 | 9/1977 | Sullivan et al. . | |
| 4,194,656 | 3/1980 | Zufich . | |
| 4,214,685 | 7/1980 | Pletz | 224/634 |
| 4,318,502 | 3/1982 | Lowe et al. . | |
| 4,420,103 | 12/1983 | Douglass . | |
| 4,438,763 | 3/1984 | Zablen . | |
| 4,911,346 | 3/1990 | Shallman | 224/631 |
| 5,114,059 | 5/1992 | Thatcher | 224/643 X |
| 5,240,159 | 8/1993 | Gregory | 224/628 |
| 5,361,955 | 11/1994 | Gregory . | |
| 5,366,126 | 11/1994 | Dausien . | |
| 5,503,314 | 4/1996 | Fiscus | 224/634 X |
| 5,553,759 | 9/1996 | McMaster et al. | 224/631 |

FOREIGN PATENT DOCUMENTS

| | | | |
|---|---|---|---|
| 597307 | 5/1990 | Australia . | |
| 0 692 206A1 | 6/1995 | European Pat. Off. . | |
| 2586539 | of 0000 | France . | |
| 2 630 897 | 11/1989 | France . | |
| 2660173 | 10/1991 | France | 224/265 |
| 2754061 | of 0000 | Germany . | |
| 3918346 | of 0000 | Germany . | |
| 9211361 | of 0000 | Germany . | |
| 335 811 | 3/1959 | Switzerland . | |
| WO 97/49312 | 12/1997 | WIPO . | |

*Primary Examiner*—Renee S. Luebke
*Attorney, Agent, or Firm*—Foley & Lardner

[57] ABSTRACT

A shoulder support assembly is provided for a load carrying system having a load support structure. The shoulder support assembly includes a pair of shoulder support structures. Each shoulder support structure includes a first piece and a second piece pivotally coupled to the first piece. The first piece is adapted to extend around a user's shoulder and has a pivotal connection at a lower end. The second piece is coupled to the lower end of the first piece at the pivotal connection. Each shoulder support structure further includes pads removably connected to the first and second pieces. In addition, the suspension system has a sternum strap disposed between and mounted to the pair of shoulder support structures at the pivotal connections.

24 Claims, 4 Drawing Sheets

SHOULDER SUPPORT STRUCTURE FOR A LOAD CARRYING SYSTEM

BACKGROUND OF THE INVENTION

The present invention relates generally to a load carrying system for supporting and carrying loads on a user's back. More particularly, the present invention relates to a shoulder support structure for a load carrying system for adequately and comfortably supporting a load, such as a backpack or a buoyancy compensator, on a user's back and hips while providing the user with considerable freedom of movement.

Conventional backpacks and similar structures for supporting loads on a user's back typically include a load carrying compartment and shoulder straps. While small capacity packs often require no other support structure for comfortably supporting the load, larger capacity packs and carrying systems, such as buoyancy compensators for divers, often include a rigid frame structure and a hip strap designed to lend additional support to the load and to distribute the load properly on the user's back and hips, thereby removing strain from the back which, over time, may lead to fatigue and pain in the muscle and joints of the back.

One problem with larger and heavier load carrying systems is that they are carried differently on users of various sizes. For example, on a user with a small frame, the shoulder straps of the load carrying system may tend to slide off the user's shoulders, whereas on a user with a large frame, the shoulder straps may tend to cut into the user's torso. Ill-fitted load carrying systems are awkward and uncomfortable and may impede mobility.

There is a need, therefore, for an improved shoulder strap structure for a load carrying system that offers effective load support on the user's shoulders while allowing the user considerable freedom of movement.

SUMMARY OF THE INVENTION

The present invention features a novel shoulder strap structure for a load carrying system designed to respond to these needs. In particular, the invention provides a shoulder strap structure having multiple pieces pivotally connected to one another. Further, the shoulder strap structure provides an adjustable sternum strap that allows the shoulder strap structure to be secured across the user's chest. The sternum strap tends to orient the various elements of the straps naturally along lines of force to better support the load, and the resulting structure allows users of different sizes to comfortably carry the load.

Thus, in accordance with one aspect of the invention, a shoulder support structure is provided for a load carrying system. The load carrying system includes a load support structure configured to support a load, such as a backpack or a buoyancy compensator, on a user's back. The shoulder support structure generally includes a pair of shoulder straps, each made up of a first piece and a second piece, the first piece having an upper portion and a lower portion. The upper portion of the first piece is coupled to the load carrying system and is adapted to extend around a user's shoulder. The second piece is pivotally coupled to the lower portion of the first piece. The second piece is configured for connection to a lower region of the load carrying system.

In accordance with another aspect of the invention, a suspension system is provided for supporting a load on a user's back and hips. The suspension system includes a load carrying system and first and second shoulder strap assemblies. Each shoulder strap assembly includes a first piece, a second piece and a pivotal connection. The first piece has an upper portion which is coupled to the load carrying system and is adapted to extend around a user's shoulder. The pivotal connection is mounted on a lower portion of the first piece. The second piece is pivotally coupled to the first piece at the pivotal connection and is configured for attachment to a lower region of the load carrying system.

In accordance with a further aspect of the invention, a pad assembly is provided for a load carrying system including a load support structure. The pad assembly includes first and second shoulder straps and first and second pads. The first and second pads are removably coupled to the respective first and second shoulder straps. Each shoulder strap has a face bearing a portion of a hook and loop fastener system, while each pad has a second portion of a hook and loop fastener system.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
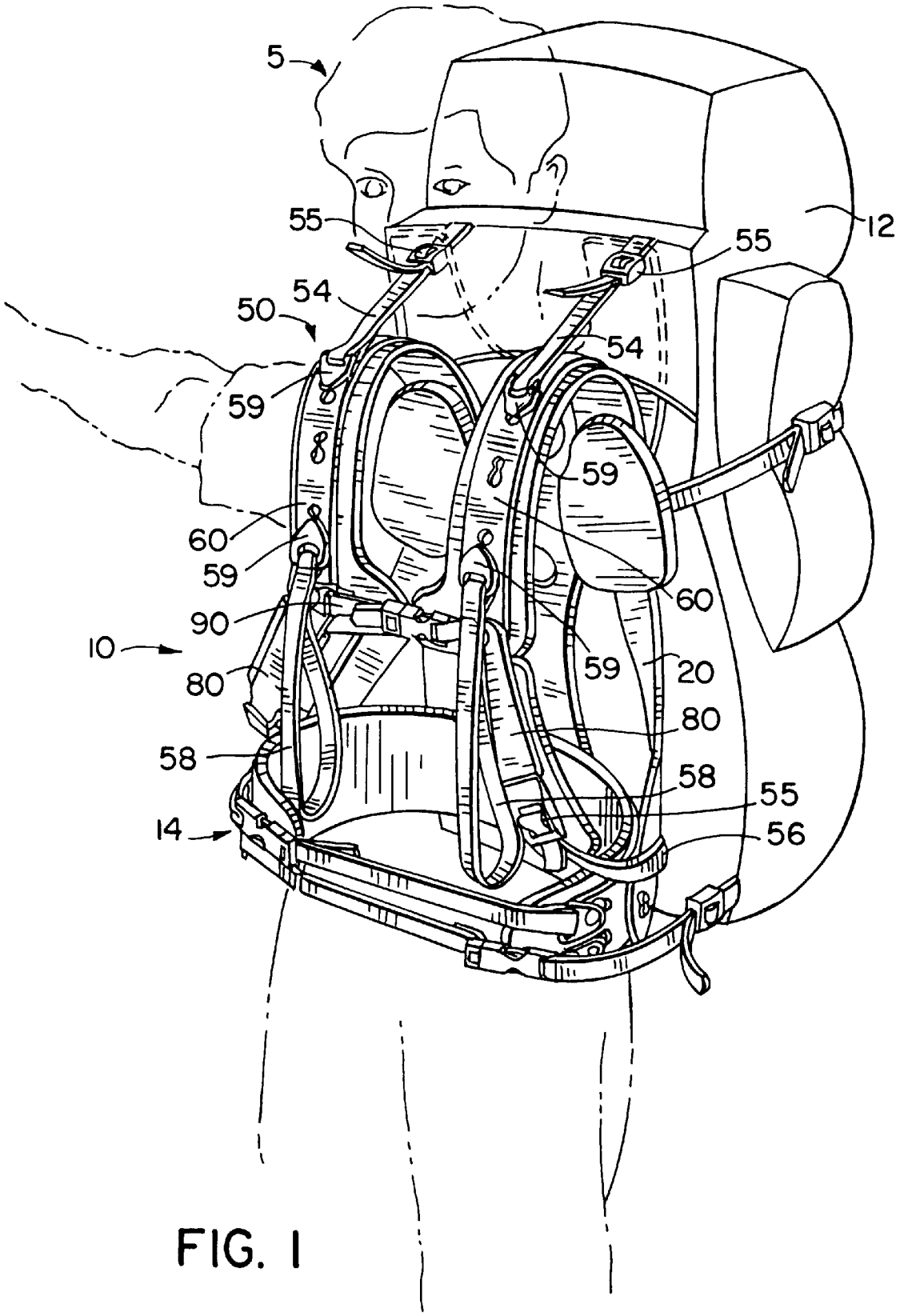
FIG. 1 is a perspective view of a shoulder support structure coupled to a load carrying system including a backpack.
Figure 2A:
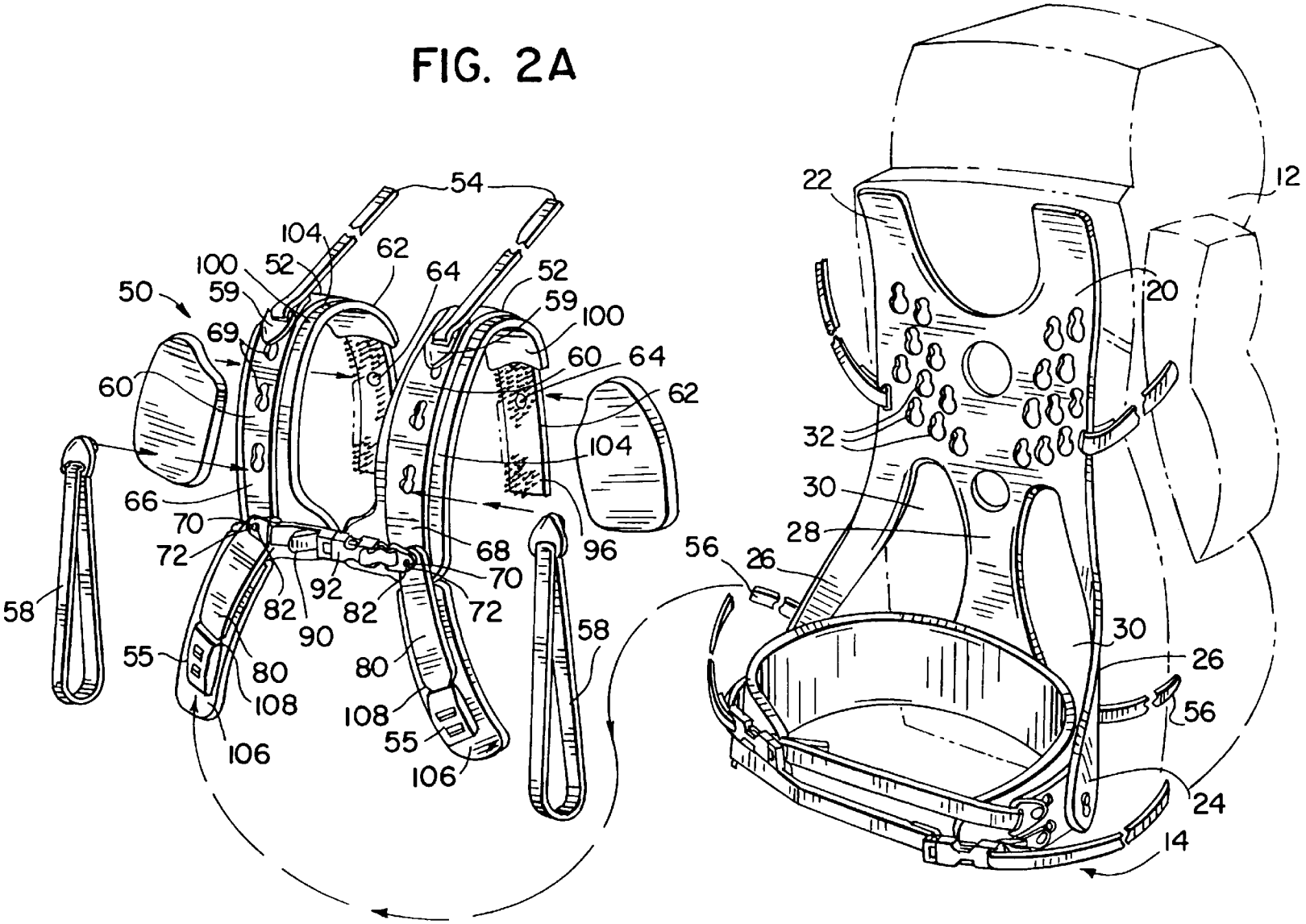
FIG. 2A is a partially exploded perspective view of the shoulder support structure shown in FIG. 1 removed from the load carrying system.

Turning now to the drawings and referring to FIGS. 1 and 2A, a load carrying system 10 is illustrated as adapted for supporting and carrying a backpack 12 on the shoulders and hips of a user 5. As illustrated in FIG. 1, load carrying system 10 includes a frame or load support structure 20, a shoulder support assembly 50 and a belt assembly 14.

Figure 2B:
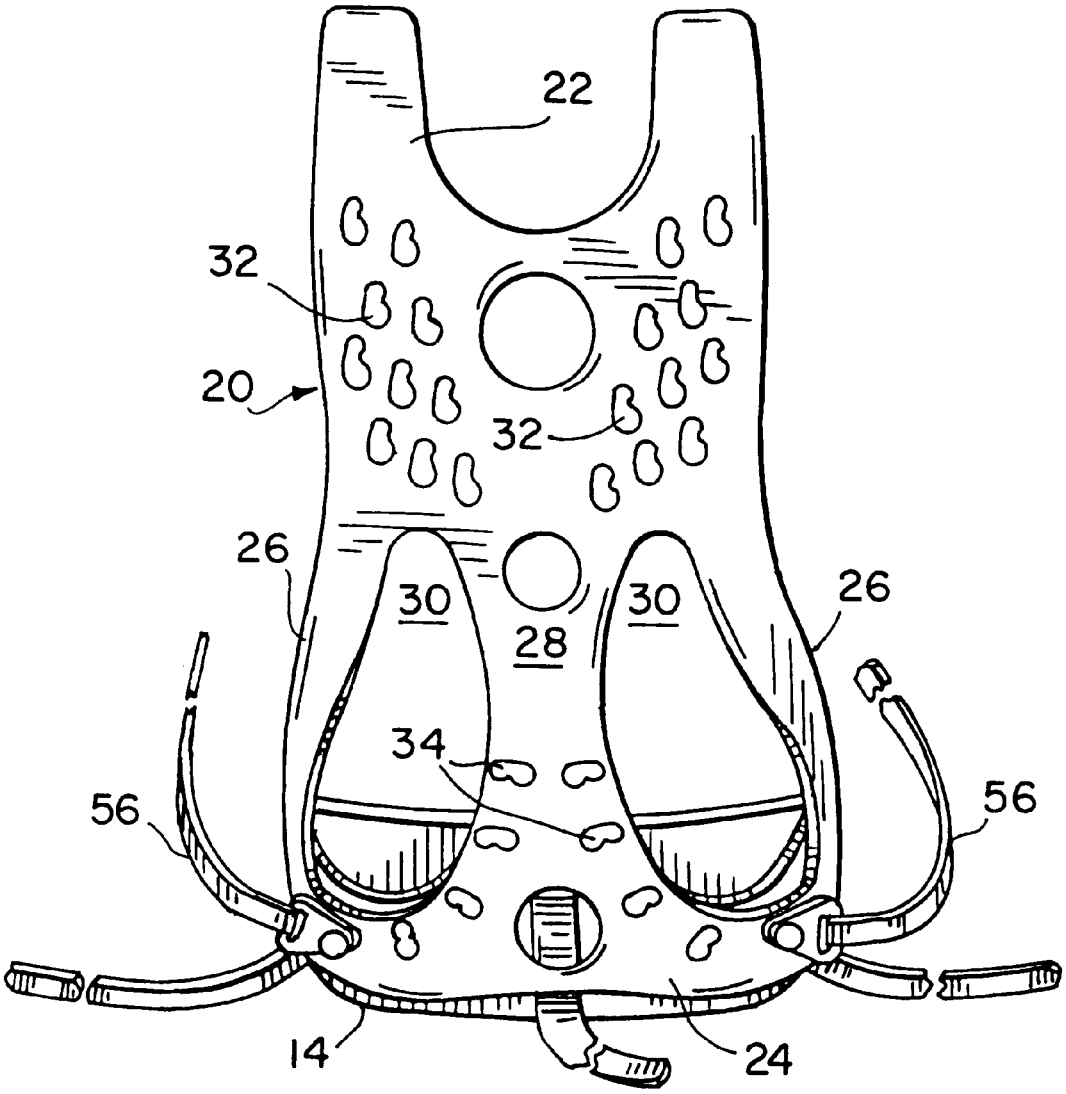
FIG. 2B is a rear view of a load support structure of the load carrying system shown in FIG. 1.
Figure 4:
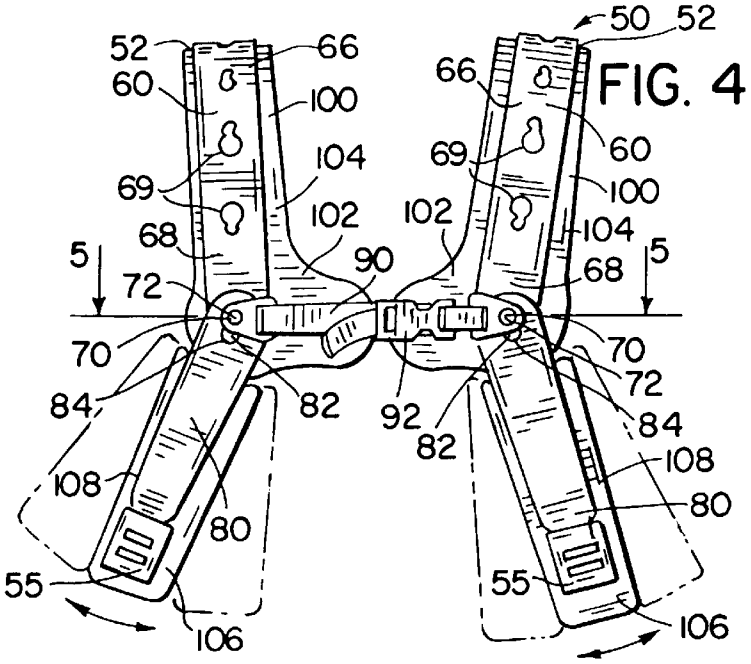
FIG. 4 is a front view of the shoulder support structure.

As illustrated in FIGS. 2A and 2B, load support structure 20 includes an upper portion 22 and a lower portion 24. Lower portion 24 has left and right struts 26 and a central panel 28 separated from struts 26 by open regions 30. Load support structure 20 is formed from a unitary piece of plastic, such as by die cutting or molding. It should be noted, however, that as used herein, the term "unitary" refers to the final construction of load support structure 20 rather than any particular method of manufacture. Thus, a welded, fused or glued assembly of elements forming a similar structure would be considered, for present purposes, to be a unitary structure. Moreover, while in the presently preferred embodiment load support structure 20 is formed from 3/16 inch thick ABS plastic sheet, other flexible materials may be substituted. The material forming load support structure 20 may be thermoformed, such as by drape molding to lend load support structure 20 a bow or camber curving inwardly toward the user. Where load support structure 20 is to be used for particularly heavy loads or where additional flexure is desired, one or more additional strips of flexible material may be secured, such as by gluing or fusing, to each strut 26 to increase its column and bending loading capacity without unnecessarily increasing the overall thickness or weight of other portions of load support structure 20.

As will be appreciated by those skilled in the art, the flexibility of load support structure 20 permits elastic deformation during use, allowing load support structure 20 to move with the user, particularly through twisting-type movements of the waist and torso. In addition, while permitting such movement, struts 26 are generally placed in compression to effectively transmit loads on load support structure 20 to belt assembly 14, thereby allowing the user to carry a greater portion of the load on the hips and legs, and relieving the shoulders and back from overloading.

As illustrated in FIGS. 1 and 2A, shoulder support assembly 50 includes a pair of shoulder support structures 52 secured to load support structure 20. Upper and lower flexible webbing straps 54 and 56 serve to attach shoulder support structures 52 to backpack 12 and to a lower portion of load support structure 20, respectively. Upper and lower webbing straps 54 and 56 are preferably adjustably and releasably secured to shoulder support structures 52 via ladder locks 55. Thus, shoulder support assembly 50 may be removed from backpack 12 and load support structure 20 by unbuckling upper and lower webbing straps 54 and 56 from ladder locks 55 and uncoupling coupling members 59 from load bearing pieces 60 (described below). When attached between shoulder support structures 52, backpack 12, and load support structure 20, upper and lower webbing straps 54 and 56 may be adjusted to comfortably position and distribute the load within backpack 12 by drawing or releasing upper and lower webbing straps 54 and 56 through ladder locks 55 in a conventional manner.

FIGS. 1, 2A, 2B, 3 and 4 illustrate a presently preferred embodiment for shoulder support assembly 50. Each shoulder support structure 52 of shoulder support assembly 50 includes a load bearing piece 60 and a lower piece 80 joined together at a pivotal connection 70. Both load bearing piece 60 and lower piece 80 are semi-rigid and preferably made of a sturdy, plastic material, such as nylon or polypropylene. The semi-rigid material of shoulder support structure 52 provides comfortable load support while permitting considerable adjustability to adapt the shoulder support structure to the user's frame. Each load bearing piece 60 is adapted to extend around a shoulder of the user. Pivotal connection 70 is mounted to a bottom portion 68 of load bearing piece 60. Lower piece 80 has an attachment point 82 that engages pivotal connection 70. In the preferred embodiment, pivotal connection 70 is a support pin having an enlarged, cylindrical head portion 72 and a shank portion 74 (see FIG. 5). Attachment point 82 is an elongate opening having an enlarged end 84 of sufficient diameter to permit passage of cylindrical head portion 72 of pivotal connection 70 and an end of reduced dimensions (not shown) for receiving and establishing coupling engagement with shank portion 74 of pivotal connection 70.

Load bearing piece 60 includes a rear attachment face 62 having an attachment pin 64 for mounting shoulder support structure 52 to load support structure 20. To receive attachment pin 64 load support structure 20 has a plurality of apertures 32 disposed in upper portion 22. Apertures 32 are similar in configuration to attachment points 82 of lower pieces 80, while attachment pins 64 are similar in configuration to pivotal connections 70. Thus, apertures 32 of load support structure 20 are adapted to receive attachment pins 64 of load bearing pieces 60 which are aligned with apertures 32 and snapped into engagement therewith, permitting configuration of the resulting assembly to accommodate various torso sizes and builds.

Load bearing piece 60 also includes a front attachment face 66. At intermediate locations of front attachment face 66 is a series of slots 69 for receiving coupling members 59 of upper webbing straps 54 and hand straps 58. Slots 69 are similar in configuration to apertures 32 of load support structure 20 and attachment points 82 of lower pieces 80. Coupling members 59 of upper webbing straps 54 and hand straps 58 include support pins (not shown) similar in configuration to attachment pins 64 and pivotal connections 70 discussed above. Thus, upper webbing straps 54 and hand straps 58 are mounted onto load bearing pieces 60 by aligning coupling members 59 with slots 69 of load bearing pieces 60 and snapping them into engagement therewith.

As best shown in FIG. 2B, lower piece 80 is pivotally coupled, via lower webbing strap 56, to load support structure 20. Lower portion 24 of load support structure 20 includes a plurality of apertures 34, similar to apertures 32, for attachment of lower piece 80. Apertures 34 are spaced along a path extending from struts 26 inward and upward along lower portion 24. This configuration of apertures 34 allows a lower portion of shoulder support structure 52 to conform to the user's build, thereby providing a more comfortable fit.

Figure 5:
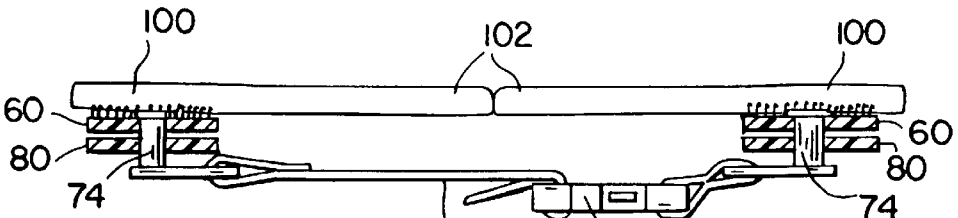
FIG. 5 is a cross-section view of the shoulder support structure taken generally along line 5—5 of FIG. 4.
Figure 3:
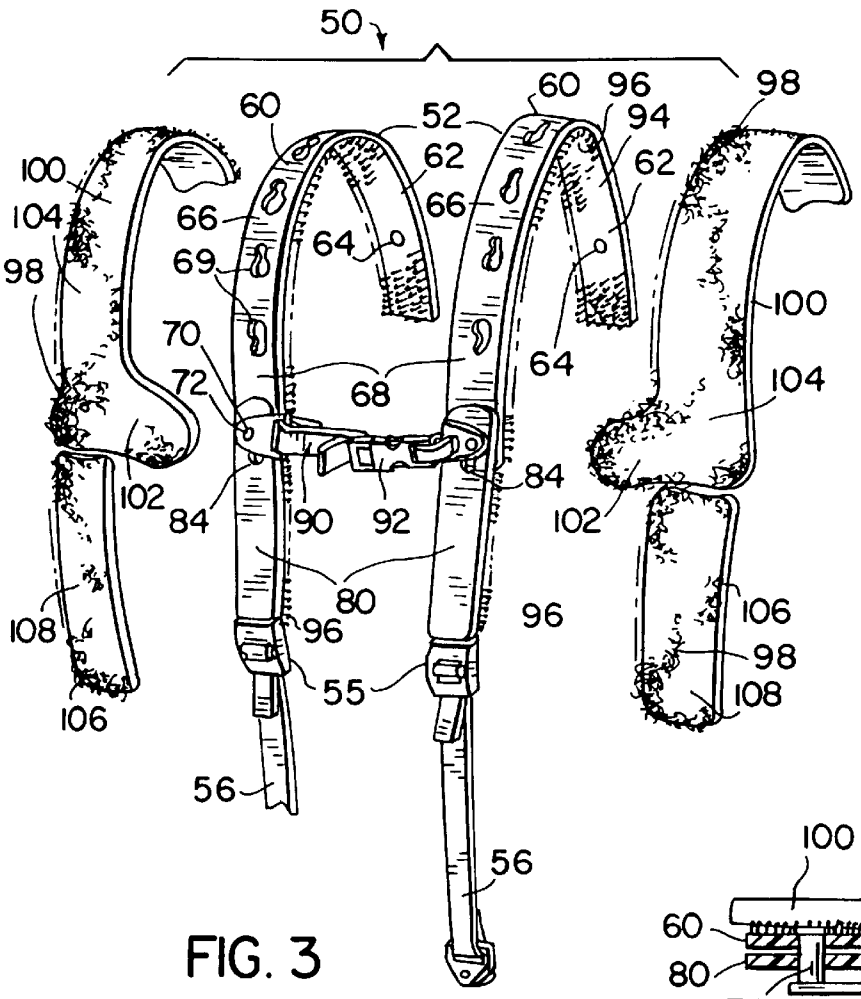
FIG. 3 is an exploded view of the shoulder support structure shown in FIG. 1 showing the pads removed from the structure.

Each shoulder support structure 52 further includes a load bearing pad 100 and a lower pad 106. Load bearing and lower pads 100 and 106 are removably positioned beneath load bearing and lower pieces 60 and 80, respectively, by a hook and loop fastener system 94. Thus, lower piece 80 and lower pad 106 may pivot with respect to load bearing piece 60 and load bearing pad 100. In the preferred embodiment, a hook portion 96 of hook and loop fastener system 94 is integrally molded in load bearing and lower pieces 60 and 80, as shown in FIGS. 2, 3 and 5. Load bearing and lower pads 100 and 106 have engagement surfaces 104 and 108, respectively, on which a loop portion 98 of hook and loop fastener system 94 is attached.

It should be noted that removable pads 100 and 106 provide several advantages over permanently attached pads of the type found in conventional backpacks and the like. First, the exact placement of removable pads on shoulder support assembly can be tailored to each user. Second, removable pads of various thicknesses are interchangeable with the same shoulder support assembly. Finally, removable pads facilitate cleaning in that they may be detached from the shoulder support assembly, washed separately and then reattached. It should also be noted that the preferred embodiment of shoulder support structures 52 obviates the need to stitch or otherwise permanently attach load bearing and lower pads 100 and 106 to load bearing and lower pieces 60 and 80, respectively, thereby facilitating the manufacture of the system and further enhancing its flexibility.

Shoulder support structures 52 are releasably coupled to one another via a sternum strap 90 including a quick release buckle 92. Sternum strap 90 is disposed between load bearing pieces 60 and is pivotally coupled to load bearing pieces 60 at pivotal connections 70. Load bearing pads 100 each have a sternum portion 102 which is disposed beneath sternum strap 90. As will be appreciated by those skilled in the art, the use of a rigid, pivotal shoulder strap system allows load bearing and lower pieces 60 and 80 to orient themselves along the natural lines of force that are developed when the user carries the load, making load carrying system 10 easier and more comfortable for the user. In particular, once sternum strap 90 is fastened between pivotal connections 70, all elements of the structure are free to pivot into alignment with lines of tensile force supporting the load. Moreover, as the user moves or adjusts the load, the entire system may flex to follow any reorientation in the lines of force.

As best illustrated in FIG. 2, shoulder support assembly 50 is attached to load support structure 20 as follows. Load bearing and lower pads 100 and 106 are positioned on load bearing and lower pieces 60 and 80, respectively, and pressed into place to lock hook and loop fastener system 96. Attachment pins 64 of load bearing pieces 60 are then inserted into appropriate apertures 32 of load support structure 20 and ladder locks 55 are secured to lower webbing straps 56. Coupling members 59 of upper webbing straps 54 are positioned in slots 69 of load bearing pieces 60. Webbing straps 54 and 56 may then be adjusted in length as desired for comfort and support.

It will be understood that the foregoing description is of a preferred embodiment of this invention and that the invention is not limited to the specific forms shown or described. For example, a single, rather than double, pad may be used in combination with each shoulder support structure. The single pad may extend only over the portion of the load bearing piece or may span the full length of the load bearing and lower pieces. Also, the pads need not be removable, but can be attached by plastic rivets or any other known technique. In addition, while it is preferred that the hook portion of the hook and loop fastener system is molded into the load bearing and lower pieces, the hook portion may also be attached by glue or ultrasonic welding. Moreover, various alternative engagement configurations may be envisioned in place of the pin and slot arrangements described. Also, while it is preferred to provide a structure that is detachable from the load itself, the pivotal shoulder support structure described may be provided in a load carrying system in which the shoulder straps are permanently or semi-permanently attached to the load support at their upper or lower ends, or at both ends. In addition, load bearing and lower pieces need not be separate pieces but, rather, may be reinforced portions of a single piece that are separated by a fabric connection. These portions may be reinforced through various means including a pad or plastic insert or an external frame. These and other modifications may be made in the design and arrangement of other elements without departing from the scope of the invention as expressed in the appended claims.

I claim:

1. A shoulder support structure for a load carrying system including a load support structure configured to support a load on a user's back, the shoulder support structure comprising:

a first piece made of semi-rigid plastic having an upper portion and a lower portion, the upper portion adapted to be coupled to the load carrying system and adapted to extend between the user's front and back;

a first pad coupled to the first piece;

a sternum strap pivotably coupled to the lower portion of the first piece;

a second piece made of semi-rigid plastic pivotably coupled at the sternum strap to the lower portion of the first piece, the second piece configured for connection to a lower region of the load carrying system; and a second pad coupled to the second piece, wherein the first pad, the second pad and the sternum strap pivot relative to one another.

2. The shoulder support structure as recited in claim 1, further comprising a pivot pin extending between the lower region of the first piece and the second piece for pivotally coupling the second piece to the first piece.

3. The shoulder support structure as recited in claim 1, wherein the first and second pads are removably coupled to the first and second pieces, respectively.

4. The shoulder support structure as recited in claim 3, wherein the first and second pads are removably attached to the first and second pieces by first and second hook and loop fastener systems, respectively.

5. The shoulder support structure as recited in claim 1, wherein the first piece has a plurality of attachment holes disposed therein, the plurality of attachment holes configured to receive a flexible webbing strap for coupling the first piece to the load support structure.

6. The shoulder support structure as recited in claim 1, further comprising a flexible webbing strap coupled to the second piece and adapted to secure the second piece to the load carrying system.

7. A suspension system for supporting a load on a user's back, the suspension system comprising:

a load carrying system;

first and second shoulder strap assemblies, each shoulder strap assembly including:

a first piece having an upper portion and a lower portion, the upper portion coupled to the load carrying system and adapted to extend between the user's front and back;

a first pad coupled to the first piece;

a pivotal connection mounted on the lower portion of the first piece proximate the user's sternum, a second piece pivotally coupled to the lower portion of the first piece at the pivotal connection, the second piece attached to a lower region of the load carrying system;

a second pad coupled to the second piece, wherein the first and second pads pivot relative to one another about the pivotal connection; and a sternum strap extending between the pivotal connections of the first and second shoulder strap assemblies.

8. The suspension system as recited in claim 7, wherein the first and second pieces are made of a semi-rigid plastic material.

9. The suspension system as recited in claim 7, wherein the first and second pads are removably coupled to the first and second pieces, respectively, by a hook and loop fastener.

10. The suspension system as recited in claim 9, wherein a hook portion of the hook and loop fastener is integrally molded in the first and second pieces.

11. The suspension system as recited in claim 7, wherein each first piece has a plurality of attachment holes disposed therein, the plurality of attachment holes configured to receive a flexible webbing strap for coupling the first piece to the load carrying system.

12. The suspension system as recited in claim 7, wherein the lower region of the load carrying system has a plurality of attachment points for adjustably and pivotally coupling the second piece of each shoulder strap assembly.

13. The suspension system as recited in claim 7, wherein the sternum strap is pivotably coupled to the pivotal connections of the first and second shoulder strap assemblies, whereby the sternum strap, the first pad and the second pad each pivot about the pivotal connections.

14. The suspension system as recited in claim 7, further comprising a flexible webbing strap coupled to the second piece and attaching the second piece to the load carrying system.

15. A pad assembly for a load carrying system including a load support structure configured to support a load on a user's back, the pad assembly comprising:

first and second shoulder straps including:

a first piece having an upper portion and lower portion, the upper portion adapted to be coupled to the load support structure and adapted to extend between the user's front and back;

a pivotal connection mounted on the lower portion of the first piece proximate the user's sternum; and a second piece pivotally coupled to the lower portion of the first piece at the pivotal connection, the second piece configured to be connected to a lower region of the load carrying system;

a sternum strap extending between the first pieces of the first and second shoulder straps, the sternum strap pivotally coupled to the pivotal connections; and first and second pads, wherein each pad includes a sternum portion, the sternum portion being disposed beneath the sternum strap when each pad is mounted on each respective first piece.

16. The pad assembly as recited in claim 15, wherein the first and second pieces are made of a semi-rigid plastic material.

17. The pad assembly as recited in claim 15, wherein a hook portion of a hook and loop fastener is integrally molded in the first and second pieces.

18. The pad assembly as recited in claim 15, wherein each first piece has a plurality of attachment holes disposed therein, the plurality of attachment holes configured to receive a flexible webbing strap for coupling each first piece to the load support structure.

19. The pad assembly as recited in claim 15, further comprising a flexible webbing strap coupled to the second piece and attaching the second piece to the load carrying system.

20. The pad assembly as recited in claim 15 wherein each of the first and second shoulder straps has a face bearing a portion of a hook and loop fastener system and wherein each of the first and second pads has a second portion of a hook and loop fastener system, wherein the first and second pads are removably coupled to the first and second shoulder straps, respectively, by the hook and loop fastener system.

21. A suspension system for supporting a load on a user's back and hips, the suspension system comprising:

a load carrying system; and first and second shoulder strap assemblies, each shoulder strap assembly including a first semi-rigid piece having an upper portion and a lower portion, the upper portion coupled to the load carrying system and adapted to extend between the user's front and back, a pivotal connection mounted on the lower portion of the first piece, and a second semi-rigid piece pivotally coupled to the lower portion of the first piece at the pivotal connection and rotatable in a plane substantially parallel to the user's front, the second piece attached to a lower region of the load carrying system.

22. A suspension system for supporting a load on a user's back and hips, the suspension system comprising:

a load carrying system; and first and second shoulder strap assemblies, each shoulder strap assembly including a first piece having an upper portion and a lower portion, the upper portion coupled to the load carrying system and adapted to extend between the user's front and back, a pivotal connection mounted on the lower portion of the first piece, and a second piece pivotally coupled to the lower portion of the first piece at the pivotal connection, the second piece attached to a lower region of the load carrying system, the first and second pieces being made of a semi-rigid plastic material.

23. A suspension system for supporting a load on a user's back and hips, the suspension system comprising:

a load carrying system; and first and second shoulder strap assemblies, each shoulder strap assembly including an upper portion, a lower portion, and a plurality of attachment members at a plurality of locations along the upper portion, the upper portion coupled to the load carrying system and adapted to extend between the user's front and back, the plurality of attachment members configured to attach a flexible webbing strap to each shoulder strap assembly at one of the plurality of locations to couple the shoulder strap assemblies to the load carrying system.

24. The suspension system as recited in claim 23, wherein the plurality of attachment members are holes.

* * * * *